United States Patent [19]

Shimura et al.

[11] Patent Number: 4,634,156

[45] Date of Patent: Jan. 6, 1987

[54] DOOR LOCK DEVICE

[75] Inventors: Ryoji Shimura, Yokohama; Osamu Seko, Fujisawa, both of Japan

[73] Assignees: Nissan Motor Co., Ltd.; OHI Seisakusho Co., Ltd., both of Yokohama, Japan

[21] Appl. No.: 601,599

[22] Filed: Apr. 18, 1984

[30] Foreign Application Priority Data

Apr. 21, 1983 [JP] Japan ..... 58-69134

[51] Int. Cl.[4] ..... E05C 3/26

[52] U.S. Cl. ..... 292/216; 292/DIG. 26

[58] Field of Search ..... 292/216, 280, DIG. 26, 292/DIG. 24, DIG. 23

[56] References Cited

U.S. PATENT DOCUMENTS

| | | | |
|---|---|---|---|
| 3,999,791 | 12/1976 | Torii | 292/280 X |
| 4,073,519 | 2/1978 | Kurozu et al. | 292/216 |
| 4,097,077 | 6/1978 | Gahrs | 292/216 |
| 4,364,590 | 12/1982 | Hamada | 292/216 X |

FOREIGN PATENT DOCUMENTS

| | | |
|---|---|---|
| 2442797 | 3/1976 | Fed. Rep. of Germany . |
| 50-18259 | 6/1975 | Japan . |
| 50-20427 | 6/1975 | Japan . |
| 52-137817 | 11/1977 | Japan . |
| 55-11405 | 3/1980 | Japan . |

*Primary Examiner*—Richard E. Moore

*Attorney, Agent, or Firm*—Schwartz, Jeffery, Schwaab, Mack, Blumenthal & Evans

[57] ABSTRACT

When an open lever assumes a position causing a latching member to release a striker, an arm portion of the open lever intersects a travelling path of a key cylinder-actuated lever which is synchronously pivotal with a locking knob-actuated lever. Thus, when the door is opened, the locking knob can not be shifted to its locking position thereby suppressing a so-called "keyless locking".

17 Claims, 7 Drawing Figures

DOOR LOCK DEVICE

BACKGROUND OF THE INVENTION

1. Field of the Invention

The present invention relates in general to a door lock device, and more particularly to an automotive door lock device of a type which has an "anti-keyless" locking function.

2. Description of the Prior Art

Hitherto, many types of automotive door lock devices have been proposed. Some of them are of a type which has a so-called "keyless locking" function in which the door can be locked from the outside without using a key. Examples of this type of device are disclosed in Japanese Utility Model Application Second Publications Nos. Sho 55-11405, 55-29781 and 50-18259. Usually, keyless locking is carried out by pushing down the locking knob with the door opened and then closing the door with the outside handle manipulated to the opening position. However, current wide usage of such door lock devices has inevitably brought about a problem in that the door is frequently locked by way of the keyless locking with the key left in the vehicle cabin. In this case, the door can no longer be opened from the outside in the normal way.

Some of the hitherto proposed door lock devices are of a type which does not have the keyless locking function. This type of door lock device is disclosed in, for example, Japanese Utility Model Application Second Publication Sho No. 50-20427 and Japanese Patent Application First publication Sho No. 52-137817. However, this type of lock device, that is, a so-called "anti-keyless locking" type, is not provided with a free wheel (or air striking) mechanism, so that the durability of it is relatively poor. Furthermore, the locking of the door is effected only when the door is fully closed, that is, when the device is in the fully latching condition. In other words, the key cylinder can not be turned to its door locking position when the door is in the half-latched position. Thus, this type door lock device induces a high possibility of damaging the key because of careless key manipulation under the half-latched condition of the door.

SUMMARY OF THE INVENTION

It is therefore an essential object of the present invention to provide an improved door lock device having the anti-keyless locking function, which is free of the above-mentioned drawbacks.

According to the present invention, there is provided a door lock device for locking a door to a fixed member, which features a latching member having a releasing position, a half-latching position and a full-latching position, the latching member being biased toward the releasing position; a pawl member engageable with the latching member to restrain the same at the half-latching and full-latching positions; an open lever movable with the pawl member, the open lever assuming a first stop position when the latching member is in one of the half-latching and full-latching positions and a second stop position when the latching member is in the releasing position; a first actuating member having first and second conditions, the first condition being a condition in which the first actuating member is engageable with the open lever so that when the first actuating member W is moved in a given direction, the open lever is movable from the first stop position to the second stop position, the second condition being a condition in which the first actuating member is kept away from the open lever so that even when the first actuating member is moved in the given direction, the open lever is kept stationary; a second actuating member rotating the open lever from the first stop position to the second stop position when actuated; a third actuating member pivotal from a first position to cause the first actuating member to assume the first condition to a second position to cause the first actuating member to assume the second condition; a fourth actuating member pivotally movable together with the third actuating member: first means for moving through the fourth actuating member the third actuating member from the second position to the first position when the second actuating member is actuated; and second means for suppressing the pivotal movement of the third actuating member from the first position to the second position when the open lever is in the second stop position.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
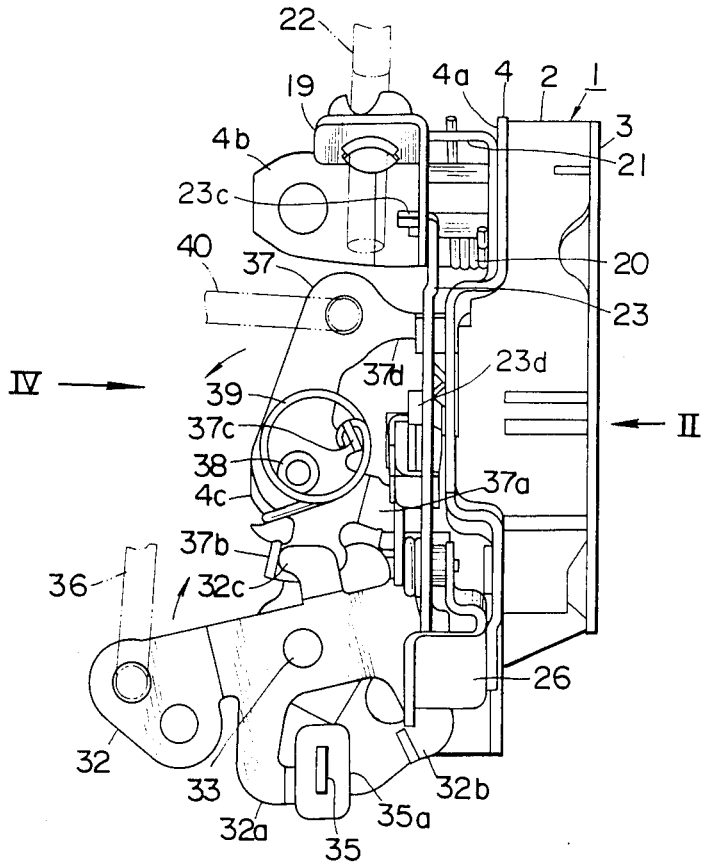
FIG. 1 is a side view of a door lock device according to the present invention, showing a condition wherein a knob lever 32 is in the locking position.

Referring to the drawings, particularly FIG. 1, there is shown a door lock device according to the present invention, which is generally designated by numeral 1.

The door lock device 1 comprises a box-shaped body 2 constructed of a rigid plastic, a cover plate 3 covering the back side of the body 2, and a base plate 4 attached to the front side of the body 2. The door lock device 1 is mounted in a swingable door (not shown) with the cover plate 3 arranged flush with the minor surface of the free end of the door.

Figure 3:
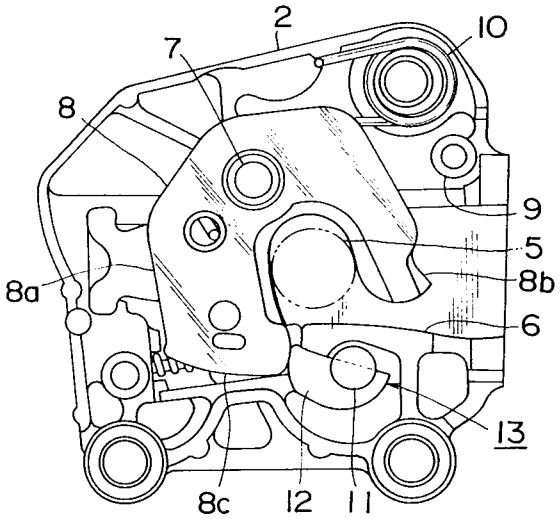
FIG. 3 is a view similar to FIG. 2, but showing a condition wherein the latching member 8 assumes its half-latching position.
Figure 2:
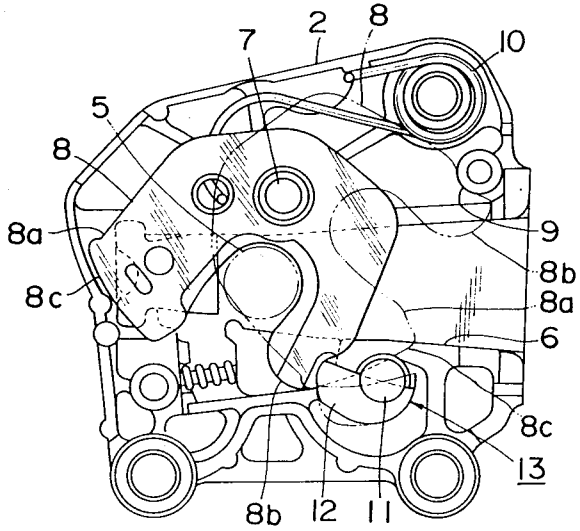
FIG. 2 is a back view of the door lock device taken from the direction of the arrow II of FIG. 1 with a cover plate 3 being removed therefrom, in which a latching member 8 assuming its full-latching position is shown by a solid line and the latching member 8 assuming its releasing position is shown by a phanton line.

As is shown in FIGS. 2 and 3, the body 2 is formed at its middle portion with a guide groove 6 into which a striker 5 secured to the vehicle body proper (not shown) is insertable upon closing of the door. The striker 5 may be of a pin-shaped type or an angular bridge-shaped type. At the upper portion of the guide groove 6, there is pivotally arranged a forked latching member 8 which is pivotal about a shaft 7.

The leading ends of the two legs 8*a* and 8*b* of the latching member 8 are equally spaced from the center of the shaft 7, and the leading end of the leg 8*a* is formed with an arcuate cam surface 8*c* which forms a part of a circle the center of which lies on the shaft 7.

The latching member 8 is pivotal about the shaft 7 to assume a releasing position as indicated by the phantom line in FIG. 2 wherein the leg 8*b* contacts a stopper 9 provided at a suitable portion of the body 2, disengaging completely the striker 5, a half-latching position as shown by FIG. 3 wherein the recess defined between the two legs 8*a* and 8*b* holds therein the striker 5 unstably, and a full-latching position as indicated by the solid line in FIG. 2 wherein the recess of the latching member 8 completely latches the striker 5. As is seen from FIG. 2, under the full-latching condition of the latching member 8, the striker 5 is held in the deep portion of the guide groove 6.

The latching member 8 is constantly biased in a counterclockwise direction as viewed in FIGS. 2 and 3, that is, toward the releasing position, by a coil spring 10 disposed about a stud (no numeral).

At the lower portion of the guide groove 6, there is rotatably disposed a shaft 11 the axis of which is parallel with the axis of the afore-mentioned shaft 7. The shaft 11 is integrally formed with a crescent pawl member 12. As will be described hereinafter, the shaft and thus the pawl member 12 are biased to rotate in the clockwise direction as viewed in FIG. 2 or FIG. 3.

The pawl member 12 constitutes a part of catching means 13 which can restrain the latching member 8 at the full-latching position. The pawl member 12 is pivotal about the axis of the shaft 11 to assume a first stop position wherein, as is indicated by the solid line in FIGS. 2 and 3, the free end of the pawl member 12 intersects the travelling path of the leading ends of the two legs 8*a* and 8*b* of the latching member 8, a releasing position (which is substantially equal to a second stop position which will be described hereinafter) wherein, as is indicated by the phantom line in FIG. 2, the free end of the pawl member 12 is slightly disengaged from the travelling path of the leading ends of the two legs 8*a* and 8*b*, and a completely releasing position (not indicated) wherein the free end of the pawl member 12 is completely disengaged or spaced apart from the travelling path. Thus, when the pawl member 12 is in the first stop position, the latching member 8, assuming the full-latching position as shown in FIG. 2 or the half-latching position as shown in FIG. 3, is prevented from rotating in the counterclockwise direction, that is, in the striker releasing direction. When the pawl member 12 is in the releasing or completely releasing position, the latching member 8 is permitted to rotate in the striker releasing direction.

As is indicated by the phantom line in FIG. 2, when the latching member 8 is in the releasing position as indicated by the phantom line, the pawl member 12 assumes a second stop position where it is in contact with the arcuate cam surface 8*c* of the leg 8*a* of the latching member 8. When, under this condition, the latching member 8 is rotated clockwise to such an extent that the leg 8*a* of the latching member 8 slides over the pawl member 12, the pawl member 12 is moved, by the biasing means, to the first stop position thereby restraining the latching member 8 at the half-latching position as is shown by FIG. 3. During clockwise rotation of the latching member 8 from the half-latching position (FIG. 3) to the full-latching position (FIG. 2), the leading end of the leg 8*b* contacts and pushes down the pawl member 12 to the second stop position, and just after the leading end of the leg 8*b* slides over the pawl member 12, the latter is returned to the first stop position thereby restraining the latching member 8 at the full-latching position as is shown in FIG. 2.

As is described hereinabove, since the leading ends of the two legs 8*a* and 8*b* of the latching member 8 are equally spaced from the center of the pivoting shaft 7, the second stop position of the pawl member 12 wherein the pawl member 12 is in contact with the arcuate cam surface 8*c* of the leg 8*a* is substantially equal to the releasing position of the pawl member 12 wherein the pawl member 12 is slightly displaced or disengaged from the travelling path of the leading ends of the legs 8*a* and 8*b*. Thus, in the following description, these equal positions will be referred to as the second stop position. However, by slightly changing the shape of the arcuate cam surface 8*c*, it becomes possible to differentiate these two positions.

Stopper means which stops the pawl member 12 at the first stop position and biasing means which biases the pawl member 12 in the clockwise direction in FIGS. 2 and 3 will be described hereinafter.

As is seen from FIGS. 1 and 4 to 7, the base plate 4 comprises a base portion 4*a* attached to the front side of the body 2 and upper and lower bracket portions 4*b* and 4*c* which are formed at right angles on the left side end (in FIG. 4) of the base portion 4*a*.

Figure 4:
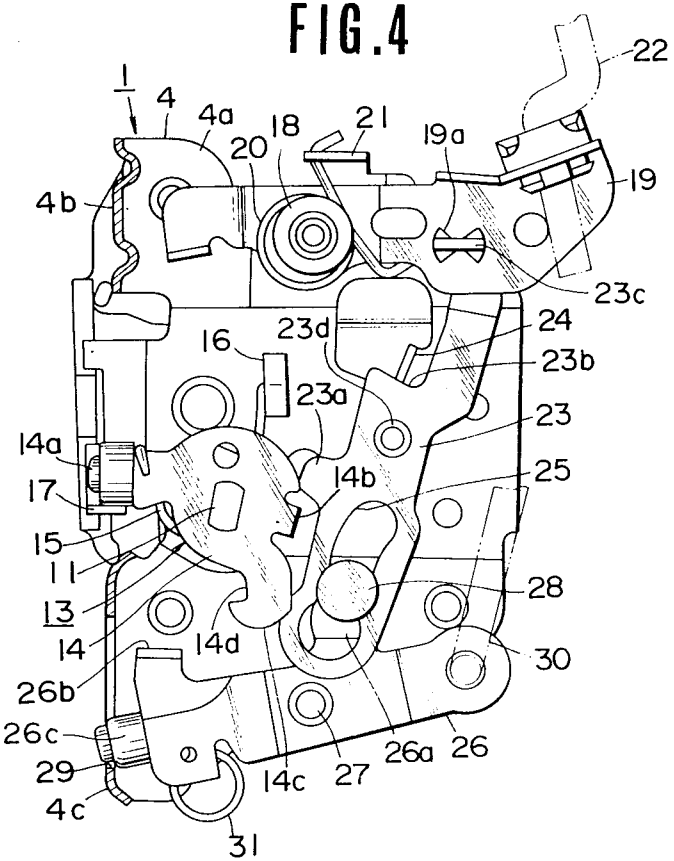
FIG. 4 is a front view of the door lock device taken from the direction of the arrow IV of FIG. 1, showing a condition wherein an open lever 14 is in a first stop position and a locking-unlocking lever 26 is in its unlocking position.

As is shown in FIG. 4, at the middle portion of the base portion 4*a*, there is pivotally arranged the shaft 11 of the above-mentioned pawl member 12, which pierces through the body 2 and the base portion 4*a* and projects toward this side (in FIG. 4). The projected end of the shaft 11 has an open lever 14 secured thereto.

The open lever 14, the shaft 11 and the pawl member 12 which are combined in the afore-mentioned manner constitute the catching means 13.

The open lever 14 is provided with a first arm portion 14*a* which extends leftward in FIG. 4, a second arm portion 14*b* which is bent at right angles toward the base portion 4*a* of the base plate 4, and a third arm portion 14*c* the leading end of which is bent leftward in FIG. 4.

About the shaft 11 at the position between the base portion 4*a* of the base plate 4 and the open lever 14, there is disposed a coil spring 15. One end of the spring 15 is hooked to a lug portion 16 formed on the base portion 4*a* of the base plate 4, while, the other end of the spring 15 is hooked to the first arm portion 14*a* of the open lever 14. With this, the open lever 14 and thus the aforementioned pawl member 12 are biased in the counter-clockwise direction in FIG. 4. It is to be noted that in FIGS. 2 and 3, the pawl member 12 is thus biased in the clockwise direction.

Figure 5:
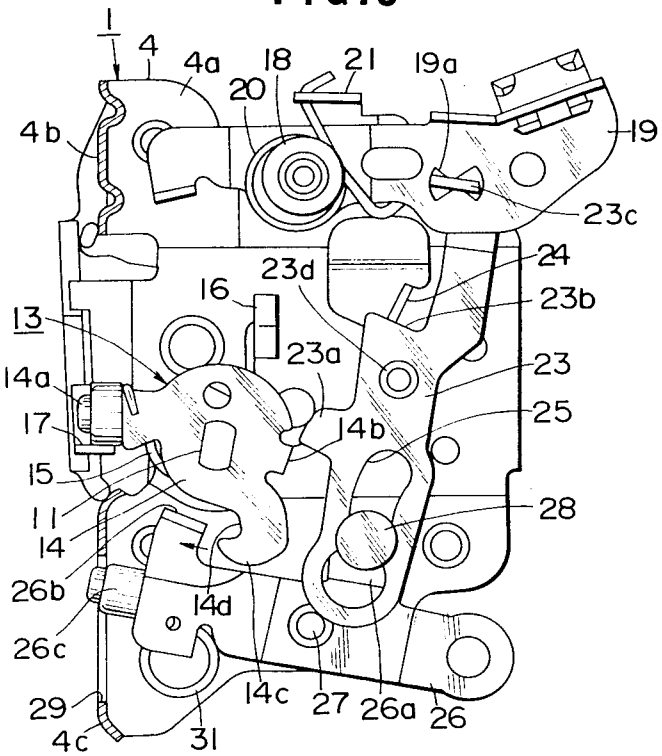
FIG. 5 is a view similar to FIG. 4, but showing a condition wherein the locking-unlocking lever 26 is in locking position.

An arrangement is so made that when the pawl member 12 assumes the afore-mentioned first stop position, the open lever 14 assumes its first stop position as shown in FIGS. 4 and 5 wherein the first arm portion 14*a* is in contact with a stopper lug 17 which is formed on the base portion 4a of the base plate 4. It is to be noted that the angular position of the open lever 14 shown by FIGS. 4 and 5 corresponds to the angular position of the pawl member 12 indicated by the solid line in FIGS. 2 and 3.

Figure 6:
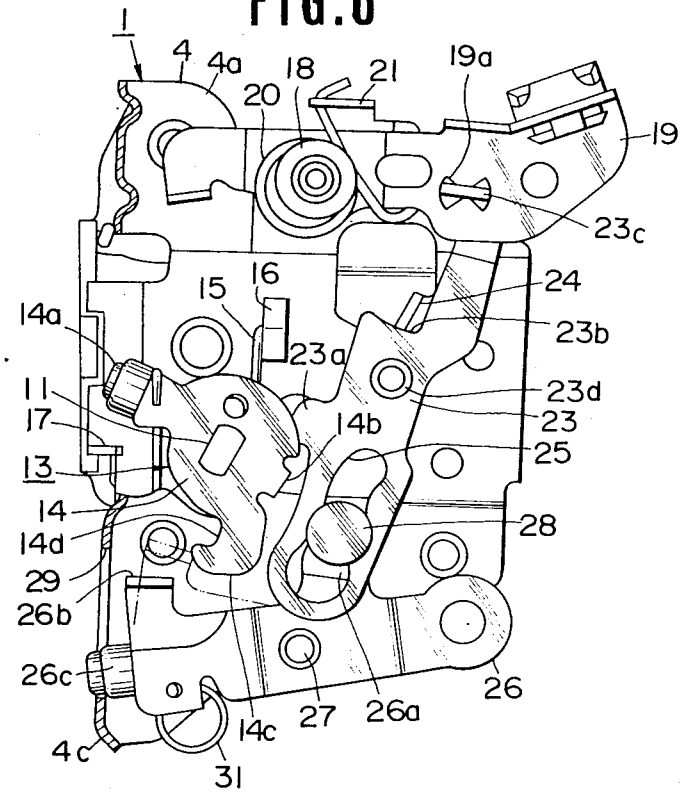
FIG. 6 is a view similar to FIG. 4, but showing a condition wherein the open lever 14 is in a second stop position and the locking-unlocking lever 26 is in its unlocking position.

When the pawl member 12 is in the second stop position wherein it is in contact with the arcuate cam surface 8c of the leg 8a of the latching member 8, the open lever 14 assumes its second stop position as shown by FIG. 6. It is to be noted that the angular position of the open lever 14 shown by FIG. 6 is corresponding to the angular position of the pawl member 12 shown by the phantom line in FIG. 2. Thus, when the open lever 14 is rotated clockwise against the biasing spring 15 from the position shown in FIG. 4 or 5 to the position shown in FIG. 6, the pawl member 12 is disengaged from the latching member 8 thereby permitting the latching member 8 to pivot in the striker releasing direction. In this condition, the door can be opened.

As is seen in FIGS. 4 to 6, to the upper portion of the base portion 4a of the base plate 4, there is secured a shaft 18 which has an enlarged head portion. An outside lever 19 is supported by the shaft 18 so that it is pivotal about the shaft 18. A coil spring 20 is disposed about the shaft 18 with one end hooked to a lug 21 formed on the base portion 4a and the other end hooked to the outside lever 19, so that the outside lever 19 is biased to rotate about the shaft 18 in the counterclockwise direction in FIGS. 4 to 6.

As is seen in FIG. 4, the right end of the outside lever 19 is pivotally connected to the lower end of a rod 22 which is linked to a known outside handle (not shown) mounted to the door. Thus, when the outside handle is manipulated by an operator, the rod 22 is moved down thereby pivoting the outside lever 19 in the clockwise direction against the biasing force of the coil spring 20.

The right end of the outside lever 19 is formed with an opening 19a with which a bent upper portion 23c of a sub-lever 23 is pivotally engaged. The sub-lever 23 is provided at its middle portion with a projection 23a which extends toward the open lever 14. By the action of a lever (26) which will be described hereinafter, the sub-lever 23 pivots about the bent upper portion 23c thereof between a releasing position as shown by FIG. 4 wherein the projection 23a intersects the travelling path described by the second arm portion 14b of the afore-mentioned open lever 14 and a locking position as shown by FIG. 5 wherein the projection 23a is disengaged from the travelling path of the second arm portion 14b.

The sub-lever 23 is formed with a stepped portion 23b at a portion between the bent upper portion 23c and the projection 23a. The stepped portion 23b is in contact with a lug 24 formed on the base portion 4a of the base plate 4, so that excess upward movement of the sub-lever 23 is suppressed by the lug 24.

Thus, when the sub-lever 23 is in the releasing position (FIG. 4), manipulation of the outside handle (not shown) of the door induces the clockwise rotation of the outside lever 19, moving down the sub-lever 23, bringing the 23a into contact with the second arm portion 14b of the open lever 14, and thus rotating the open lever 14 in the clockwise direction in FIG. 4 to the position shown in FIG. 6. With this rotation of the open lever 14, the pawl member 12 is brought into the completely releasing position. Thus, the door can be opened. However, when the sub-lever 23 is in the locking position (FIG. 5), the manipulation of the outside handle of the door brings about only air striking of the projection 23a. Thus, in this condition, the pawl member 12 is not brought into the releasing position. That is, the door can not be opened even when the outside handle of the door is manipulated.

The lower portion of the sub-lever 23 is formed with an elongate opening 25 which is curved slightly as shown. Designated by reference numeral 23d is a plastic spacer which is fixed to the sub-lever 23 for preventing direct contact between the base portion 4a of the base plate 4 and the sub-lever 23 upon relative movement therebetween.

To the lower portion of the base portion 4a of the base plate 4, there is secured a shaft 27 through which a locking-unlocking lever 26 is pivotally connected to the base portion 4a. The lever 26 has an upwardly extending arm 26a to which is secured a pin 28 having an enlarged head portion. The pin 28 is slidably engaged with the elongated opening 25 of the sub-lever 23. The left end 26c of the locking-unlocking lever 26 is positioned in an elongate opening 29 formed in the lower bracket portion 4c of the base plate 4. The elongate opening 29 is so sized as to permit a certain degree of vertical movement of the left end 26c of the lever 26. The right end of the locking-unlocking lever 26 is pivotally connected to the lower end of a rod 30 which is linked to a known key cylinder (not shown) mounted to the outside portion of the door. By manipulating the key cylinder, the locking-unlocking lever 26 is pivotal between a lock cancelling position as shown by FIG. 4 wherein the locking of the latching member 8 is cancelled and a lock position as shown by FIG. 5 wherein the locking of the latching member 8 is established.

Designated by numeral 31 is an over-center spring (or a snap action spring) one end of which is hooked to the base portion 4a of the base plate 4 and the other end of which is hooked to the left end of the locking-unlocking lever 26. With this, the locking-unlocking lever 26 is forced to pivot in a snap action manner between the lock cancelling position (FIG. 4) and the lock position (FIG. 5).

The left end of the locking-unlocking lever 26 is formed with an upwardly extending portion 26b the top of which is bent toward this side (in FIG. 4).

The locking-unlocking lever 26 and the open lever 14 are so arranged that when the open lever 14 is in its first stop position (FIGS. 4 and 5), the hook portion of the third arm portion 14c of the open lever 14 is disengaged from the travelling path of the upwardly extending portion 26b of the locking-unlocking lever 26, and that when the open lever 14 is in its second stop position (FIG. 6) or a position beyond the second stop position, the hook portion of the third arm portion 14c intersects the path. Thus, when the open lever 14 is in its second stop position (FIG. 6), the pivoting movement of the locking-unlocking lever 26 from its lock cancelling position (FIG. 4) to its lock position (FIG. 5) is prevented by the third arm portion 14c of the open lever 14, as is understood from the position of the upwardly extending portion 26b indicated by the phantom line in FIG. 6.

In order to make the latching member 8 freely rotate from the half-latching position (FIG. 3) to the full-latching position (FIG. 2, indicated by the solid line) under the condition wherein the locking-unlocking lever 26 is in its lock position (FIG. 5), the open lever 14 is formed at the third arm portion 14c with a suitable recess 14d which is sized to receive the upwardly extending portion 26*b* of the locking-unlocking lever 26. With the provision of the recess 14*d*, one reciprocating movement of the open lever 14 which occurs during the above-mentioned rotation of the latching member 8 due to the temporary contact between the leg 8*b* of the latching member 8 and the pawl member 12 (see FIGS. 2 and 3) is assured without being obstructed by the upwardly extending portion 26*b* of the locking-unlocking lever 26. If desired, a recess may be formed at the upwardly extending portion 26*b* of the locking-unlocking lever 26 as a substitute for the recess 14*d*.

Figure 7:
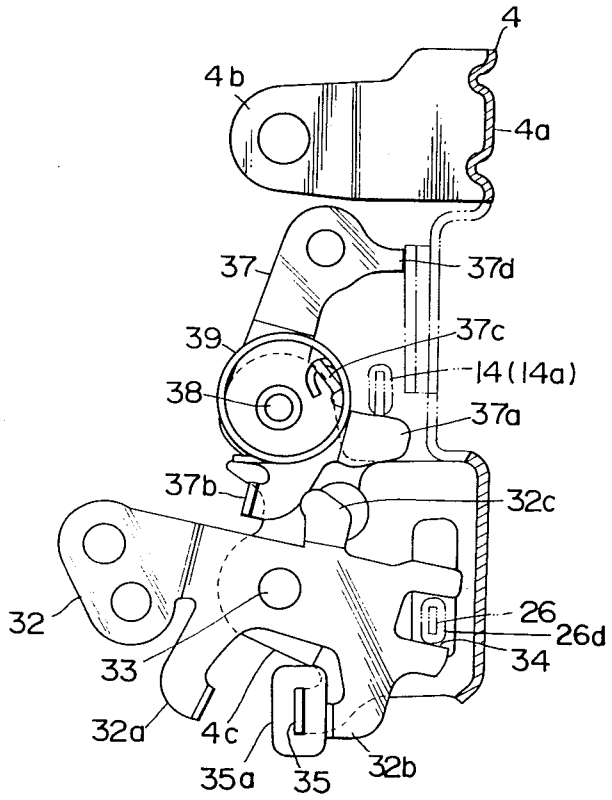
FIG. 7 is a side view of the door lock device with a latch device section removed therefrom, showing a condition wherein the knob lever 32 is in the unlocking position.

As is seen in FIGS. 1 and 7, to the lower bracket portion 4*c* of the base plate 4, there is pivotally connected through a shaft 33 a knob lever 32. The right end (see FIG. 7) of the knob lever 32 is formed with a rectangular recess 34 which receives therein the afore-mentioned left end 26*c* of the locking-unlocking lever 26. The left end 26*c* of the locking-unlocking lever 26 is equipped with a lubricating means such as a plastic grommet 26*d* for achieving an effective pivotal connection between the knob lever 32 and the locking-unlocking lever 26. With this, the pivoting movement of the locking-unlocking lever 26 induces a simultaneous pivoting movement of the knob lever 32, and vice versa. More particularly, when the locking-unlocking lever 26 assumes its lock cancelling position (FIG. 4), the knob lever 32 assumes its lock cancelling position as shown by FIG. 7, while, when the locking-unlocking lever 26 assumes its lock position (FIG. 5), the knob lever 32 assumes its lock position as shown by FIG. 1. The knob lever 32 is formed with a pair of downwardly extending arm portions 32*a* and 32*b* which put therebetween, with predetermined spaces, a stopper 35 provided on the lower bracket portion 4*c* of the base plate 4. A shock absorbing member 35*a* is equipped to the stopper 35. Thus, by the engagement of the stopper 35 with either the arm portion 32*b* or the other arm portion 32*a*, the lock position and the lock cancelling position of the knob lever 32 are assuredly settled.

The knob lever 32 is formed with an upward projection 32*c* for the purpose which will be described hereinafter.

As is shown in FIG. 1, the left end of the knob lever 32 is pivotally connected with a rod 36 which is linked to a known locking knob (not shown) which is mounted in the inboard side of the door in a manner to be projectable therefrom. By manupulating or pushing down the locking knob, the knob lever 32 is turned to its lock position (FIG. 1) causing the locking-unlocking lever 26 to assume its lock position (FIG. 5).

As is seen in FIGS. 1 and 7, to the upper portion of the lower bracket portion 4*c* of the base plate 4, there is pivotally connected through a shaft 38 an inside lever 37. The inside lever 37 is formed with both a first lug 37*a* which extends toward the open lever 14 to be engageable with the first arm portion 14*a*, and a second lug 37*b* which extends toward the knob lever 32 to be engageable with the upward projection 32*c*.

Designated by numeral 39 is a coil spring which has one end hooked to a lug 37*c* of the inside lever 37 and the other end hooked to a suitable portion of the lower bracket portion 4*c* of the base plate 4. With the force of the spring 39, the inside lever 37 is biased in the clockwise direction in FIGS. 1 and 7. Usually, the inside lever 37 assumes the rest position as shown in FIGS. 1 and 7 wherein a stopper lug 37*d* of the inside lever 37 is in abutment with the base portion 4*a* of the base plate 4.

As is seen from FIG. 1, the upper end of the inside lever 37 is pivotally connected with a rod 40 which is linked to a known inside handle (not shown) which is mounted to the inboard side of the door. By manipulating or pulling the inside handle, the inside lever 37 is rotated against the spring 39 in the counterclockwise direction in FIGS. 1 and 7 from the rest position. Thus, when the open lever 14 assumes its first stop position (FIGS. 4 and 5) and the knob lever 32 assumes its lock position (FIG. 1), the counterclockwise rotation of the inside lever 37 causes the first and second lugs 37*a* and 37*b* to push the first arm portion 14*a* of the open lever 14 and the upward projection 32*c* of the knob lever 32, respectively, so that, finally, the open lever 14 is turned to the second stop position (FIG. 6), and the knob lever 32 is returned to its lock cancelling position (FIG. 7). Once the open lever 14 and the knob lever 32 assume the new positions, the inside lever 37 is forced to return to its rest position by the action of the spring 39.

As will be apparent as the description proceeds, the above-mentioned function is a so-called "over-ride" function. That is, the locked condition of the door lock device 1 can be cancelled by only manipulating the inside handle of the door without, prior to this, manipulating or lifting up the locking knob. This function is very convenient because in an emergency case such as a vehicle accident, the passenger can get out of the vehicle cabin quickly.

In the following, operation of the door lock device 1 will be described. For ease with which explanation of the operation is made, the following description will be commenced with respect to a condition wherein the door is fully opened. In this condition, the door lock device 1 in the door assumes its rest condition wherein the latching member 8 assumes the releasing position as indicated by the phantom line in FIG. 2, the outside lever 19, the sub-lever 23, the open lever 14, and the locking-unlocking lever 26 assume the positions as shown by FIG. 6 and the knob lever 32 and the inside lever 37 assume the positions as shown by FIG. 7.

When the door is closed, the striker 5 secured to the vehicle body is inserted into the guide groove 6 of the body 2 of the door lock device 1, and brought into engagement with the latching member 8 causing the same to rotate from the releasing position to the full-latching position through the half-latching position. In the full-latching position, the pawl member 12 is forced to stop at the first stop position (indicated by the solid line in FIG. 2), so that rotation of the latching member 8 toward the releasing position is blocked by the pawl member 12 thereby keeping the door in its closed or full-latched position. In this condition, the parts of the door lock device 1 assume the positions as shown by FIGS. 2 (solid line), 4 and 7. This condition will be referred to as "closed condition of the door" hereinafter.

When, then, the outside handle is manipulated for the purpose of opening the door, the outside lever 19 (see FIG. 4) is rotated clockwise shifting the sub-lever 23 downward. With this, the projection 23*a* of the sub-lever 23 is brought into engagement with the second arm portion 14*b* of the open lever 14 and rotates the open lever 14 clockwise against the force of the spring 15. Thus, the pawl member 12 rotating with the open lever 14 releases the latching member 8. By the action of the spring 10 (see FIG. 2), the latching member 8 is returned to the releasing position causing the door to open. In this condition, the parts of the door lock device 1 are returned to the positions as shown by FIGS. 2 (phantom line), 6 and 7.

When, under the closed condition of the door, the inside handle is manipulated for the purpose of opening the door, the inside lever 37 (see FIG. 7) is rotated counterclockwise causing the first lug 37*a* thereof to lift up the first arm portion 14*a* of the open lever 14. With this, the open lever 14 is rotated clockwise, like in the case of the above-mentioned manipulation of the outside handle. Thus, the latching member 8 is returned to the releasing position to cause the door to open. Also in this case, the parts of the door lock device 1 are returned to the positions as shown by FIGS. 2 (phantom line) 6 and 7.

When, under the closed condition of the door, the key cylinder is manipulated by a key for the purpose of locking the door, the locking-unlocking lever 26 (see FIG. 4) is rotated clockwise. (It is to be noted that this clockwise rotation of the lever 26 brings about the counterclockwise rotation of the knob lever 32 in FIG. 7 due to the pivotal connection therebetween). By the clockwise movement of the locking-unlocking lever 26, the pin 28 of the lever 26 (see FIG. 5) pulls the sub-lever 23 rightwardly moving the projection 23*a* of the sub-lever 23 away from the travelling path of the second arm portion 14*b* of the open lever 14. The counterclockwise rotation of the knob lever 32 (FIG. 7 to FIG. 1) caused by the movement of the locking-unlocking lever 26 pulls down the rod 36 and thus the locking knob (not shown) causing the latter to assume its locking position. Thus, in this door locking condition of the door lock device, the parts of the device assume the positions as shown by FIGS. 1, 2 (solid line) and 5.

In this condition, the movement of the sub-lever 23 is no longer transmitted to the open lever 14, so that the full-latching condition of the door lock device 1 is not cancelled even when the outside handle is manipulated for the purpose of opening the door. That is, when the outside handle is manipulated, the sub-lever strikes only air. However, when the inside handle (not shown) is manipulated for the purpose of opening the door, the inside lever 37 (see FIG. 1) is rotated counterclockwise. With this, the first lug 37*a* of the inside lever 37 lifts up the first arm portion 14*a* of the open lever 14 and substantially at the same time, the second lug 37*b* of the inside lever 37 pushes the upward projection 32*c* of the knob lever 32 (see FIG. 1) rightwardly. Thus, the open lever 14 is rotated clockwise (in FIG. 5) causing the pawl member 12 to release the latching member 8. At the same time, the knob lever 32 is rotated clockwise (in FIG. 1) causing the locking-unlocking lever 26 to rotate counterclockwise in FIG. 5 thereby moving the sub-lever 23 to the position where the projection 23*a* of the sub-lever 23 intersects the travelling path of the second arm portion 14*b* of the open lever 14. (It is to be noted that this function is a so-called "over-ride" function.). Thus, the parts of the door lock device 1 are returned to the positions as shown by FIGS. 2 (phantom line), 6 and 7.

When, under the closed condition of the door, the locking knob (not shown) is manipulated for the purpose of locking the door, the knob lever 32 is rotated counterclockwise in FIG. 7 inducing simultaneously the clockwise rotation of the locking-unlocking lever 26 in FIG. 4. Thus, the parts of the door lock device 1 assume the same positions as those provided when manipulated the key cylinder, that is, the positions as shown by FIGS. 1, 2 (solid line) and 5. Thus, the door lock device assumes the door locking condition.

When, under the door locking condition, the key cylinder is manipulated by a key for the purpose of opening the door from the outside, the locking-unlocking lever 26 is rotated counterclockwise in FIG. 5 thereby moving the sub-lever 23 to the position where the projection 23*a* thereof intersects the travelling path of the second arm portion 14*b* of the open lever 14. (Of course, at the same time, the knob lever 32 is rotated clockwise in FIG. 1 moving the upward projection 32*c* of the knob lever 32 away from the second lug 37*b* of the inside lever 37.) Thus, in this condition, the door can be unlatched only by manipulating the outside handle.

In the following, the anti-keyless locking function of the door lock device 1 will be described.

When, in order to test the anti-keyless locking function of the device 1, the door is opened to cause the door lock device 1 to assume the rest condition shown by FIGS. 2 (phantom line), 6 and 7 and then the locking knob (not shown) is manipulated for actuating the knob lever 32 and thus the locking-unlocking lever 26, counterclockwise rotation of knob lever 32 (see FIG. 7) and thus the clockwise rotation of the locking-unlocking lever 26 (see FIG. 6) can not be carried out because of the obstruction of the third arm portion 14*c* of the open lever 14. As is understood from the upwardly extending portion 26*b* of the locking-unlocking lever 26 indicated by the phantom line in FIG. 6, these rotations are blocked due to the engagement between the portion 26*b* and the third arm portion 14*c* of the open lever 14 which is then in its second stop position. This means that when the door is opened, the locking knob can not be moved to the locking position. Thus, in this condition, the keyless locking is not provided. The locking knob can not be shifted to the locking position even when it is manipulated with the outside handle being operated. This is because the manipulation of the outside handle causes the third arm portion 14*c* of the open lever 14 to penetrate deeply into the travelling path of the upwardly extending portion 26*b* of the locking-unlocking lever 26.

Thus, the undesirable matter wherein the keyless locking is carried out with the key left in the vehicle cabin can be prevented.

When, however, the door lock device 1 is in its half-latching condition, the locking knob is shiftable to its locking position because, in this condition, the open lever 14 assumes the first stop position (see FIG. 4). Thus, the door under half-latched condition can be fully latched by only pushing the door against the vehicle body strongly. During the movement of the door from its half-latched condition to its fully-latched condition, the open lever 14 undergoes one reciprocating movement due to the temporary contact between the leg 8*b* of the latching member and the pawl member 12. The reciprocating movement is permitted by the provision of the recess 14*d* of the open lever 14, as is described hereinbefore.

As is described hereinabove, the door lock device 1 of the present is based on a free-wheel (air striking) type door lock device, so that it has excellent durability. Furthermore, as the device of the invention has the above-mentioned anti-keyless locking function, the door can not be locked with the key left in the vehicle cabin. Furthermore, since the door lock device 1 permits the locking operation of the key cylinder (that is, the counterclockwise rotation of the locking-unlocking lever 26 in FIG. 4) even when it is in the half-latching condition, the hitherto encountered key damaging problem does not occur.

What is claimed is:

1. A door lock device for locking a door to a fixed member, comprising:

a latching member mounted for movement into a releasing position, a half-latching position and a full-latching position, said latching member being biased toward said releasing position;

a pawl member mounted on said device and engageable with a leg of said latching member to restrain the same at said half-latching and full-latching positions;

an open lever associated with said pawl member, said open lever having means for assuming a first stop position when said latching member is in one of said half-latching and full-latching positions, and a second stop position when said latching member is in the releasing position;

a first actuating member pivotally engaged with a movement means and being adjustable between a first movable condition and a second movable condition, said first condition providing releasable engagement of said first actuating member with said open lever so that when said first actuating member is moved, said open lever is movable from said first stop position to said second stop position, said second condition being a condition in which said first actuating member is non-engageable with said open lever;

a second actuating member mounted on said device and having means for rotating said open lever from said first stop position to said second stop position when actuated;

a third actuating member pivotally connected to said device and having means for pivoting from a first position to cause said first actuating member to assume said first condition to a second position to cause said first actuating member to assume said second condition;

a fourth actuating member having means for pivotal movement together with said third actuating member;

means formed on said second actuating member for moving said third actuating member from said second position to said first position when said second actuating member is actuated, said moving means including engagement of said third actuating member with said fourth actuating member; and means for suppressing the pivotal movement of said third actuating member from said first position to said second position when said open lever is in the second stop position.

2. A door lock device as claimed in claim 1, in which said first means comprises a lug provided to said second actuating member to move therewith, and a projection provided to said fourth actuating member to move therewith, wherein said projection is positioned away from said lug when said fourth actuating member assumes a position to cause said third actuating member to assume said first position, but positioned near said lug when said fourth actuating member assumes another position to cause said third actuating member to assume said second position.

3. A door lock device as claimed in claim 2, in which said second means comprises an arm portion provided to said open lever to move therewith, a projection provided to said third actuating member to move therewith, said arm portion having a leading end which, when said open lever is in the second stop position, intersects the travelling path described by said projection of the third actuating member.

4. A door lock device as claimed in claim 3, in which said open lever is formed at said arm portion with a recess into which said projection of said third actuating member is inserted when said open lever assumes the second stop position and said third actuating member assumes the second position.

5. A door lock device as claimed in claim 3, further comprising stopper means located on said device for positioning said third actuating member at said first and second positions.

6. A door lock device as claimed in claim 5, in which said stopper means comprises a pair of spaced arm portions provided to said fourth actuating member to move therewith, and a stopper provided to a base portion of said door lock device at a position between said pair of spaced arm portions.

7. A door lock device as claimed in claim 6, in which said stopper is wrapped with a shock absorbing member.

8. A door lock device as claimed in claim 6, in which one end of said third actuating member is pivotally connected to one end of said fourth actuating member to provide synchronous pivotal movements of them.

9. A door lock device as claimed in claim 8, further comprising biasing means for pivotally moving said third and fourth actuating members in a snap action manner.

10. A door lock device as claimed in claim 9, in which said biasing means is an over-center spring which has one end hooked to the base portion of the door lock device and the other end hooked to said third actuating member, in such a manner that the third actuating member is pivotal in a snap action manner.

11. A door lock device as claimed in claim 8, in which the one end of said third actuating member is pivotally received through a lubricating means which is provided in a recess formed in the one end of said fourth actuating member.

12. A door lock device as claimed in claim 3, in which said first actuating member is formed with an elongate opening with which a pin extending from said third actuating member is slidably engaged thereby to provide synchronous pivotal movements of said first and third actuating members.

13. A door lock device as claimed in claim 12, in which said first actuating member is formed with a projection which is engageable with an arm portion of said open lever, so that when said first actuating member in the first stop position is moved in the given direction, said projection of the first actuating member is brought into engagement with said arm portion of said open lever thereby to rotate said open lever in a direction to cause said pawl member to release said latching member.

14. A door lock device as claimed in claim 12, in which said second actuating member is formed with a lug which is brought into engagement with an arm portion of said open lever when actuated, so that when said open lever is in the first stop position, actuating of said second actuating member brings about rotation of said open lever from said first stop position to said second stop position.

15. A door lock device as claimed in claim 13, in which first actuating member is so biased that said projection of said first actuating member is moved away from said arm portion of said open lever.

16. A door lock device as claimed in claim 14, in which said second actuating member is so biased that the lugs thereof are moved away from the arm portion of the open lever and the projection of said fourth actuating member, respectively.

17. A door lock device as claimed in claim 3, in which the major surface of a base portion on which said open lever, first actuating member and third actuating member are operatively arranged in perpendicular to the major surface of a bracket portion on which said second and fourth actuating members are operatively arranged.

* * * * *